US010186370B1

(12) United States Patent
Gieras et al.

(10) Patent No.: US 10,186,370 B1
(45) Date of Patent: Jan. 22, 2019

(54) TRANSFORMERS WITH INTEGRATED INDUCTORS

(71) Applicant: Hamilton Sundstrand Corporation, Charlotte, NC (US)

(72) Inventors: Jacek F. Gieras, Glastonbury, CT (US); Gregory I. Rozman, Rockford, IL (US); Mustansir Kheraluwala, Lake Zurich, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 15/640,884

(22) Filed: Jul. 3, 2017

(51) Int. Cl.
*H01F 38/08* (2006.01)
*H01F 27/38* (2006.01)
*H01F 30/12* (2006.01)

(52) U.S. Cl.
CPC ..... *H01F 38/08* (2013.01); *H01F 27/38* (2013.01); *H01F 30/12* (2013.01)

(58) Field of Classification Search
CPC ..... H01F 29/06; H01F 29/14; H01F 29/146; H01F 2029/143; H01F 27/30; H01F 27/38; H01F 30/08; H01F 30/12; H01F 17/0033; H01F 2017/04; H01F 2017/004; H01F 2038/426
USPC ..... 323/250, 253, 307, 308, 331, 334, 335, 323/338, 362; 336/57, 83, 160, 175, 182, 336/223
See application file for complete search history.

(56) References Cited

U.S. PATENT DOCUMENTS 714,232 A 11/1902 Pichler
3,039,389 A * 6/1962 Meese ..... B41F 27/02 101/378
3,694,726 A 9/1972 Cielo et al.
4,529,956 A 7/1985 Atherton
4,613,841 A 9/1986 Roberts
5,939,966 A * 8/1999 Shin' Ei ..... H01F 27/027 336/200
6,714,428 B2 3/2004 Huang et al.
2013/0063234 A1 3/2013 Kamath et al.
2014/0210585 A1* 7/2014 Peck, Jr. ..... H01F 27/306 336/175

OTHER PUBLICATIONS

Kheraluwala, M.H,; Novotny, D.W,; Divan, D.M., Coaxially wound transformers for high-power high-frequency applications, IEEE Transactions on Power Electronics, vol. 7 Issue: 1, Jan. 1992.
Kheraluwala, M.H.; Novotny, D.W.; Divan, D.M., Design considerations for high power high frequency transformers, IEEE Power Electronics Specialists Conference, 1990.

* cited by examiner

*Primary Examiner* — Yemane Mehari
(74) *Attorney, Agent, or Firm* — Locke Lord LLP; Scott D. Wofsy; Christopher J. Child

(57) ABSTRACT

A transformer-inductor assembly includes a core, a primary winding, and a secondary winding. The primary winding is wrapped about the core. The secondary winding is wrapped about the primary winding. One or more ferromagnetic bars per phase are arranged between the secondary winding and the primary winding to control the inductance to the transformer-inductor assembly secondary winding. An electrical system including the transformer-inductor assembly and method of transforming voltage of alternating current using the transformer-inductor assembly are also described.

14 Claims, 4 Drawing Sheets

TRANSFORMERS WITH INTEGRATED INDUCTORS

BACKGROUND OF THE INVENTION

1. Field of the Invention

The present disclosure relates to electrical systems, and more particularly to transformers with integrated inductors for electrical systems.

2. Description of Related Art

Electrical systems, such as on aircraft, commonly employ transformers to provide galvanic isolation and to transform alternating current (AC) power of one voltage to AC power of another voltage. The transformers generally convert the AC power from a one voltage to another voltage by converting electrical current provided to input windings into variant magnetic flux within the transformer core, which is communicated to transformer output windings to induce output voltage in the output windings. An inductor component is generally connected to the transformer output windings to support operation of power converters, such as active rectifiers, to supply direct current (DC) power to electrical loads connected to the power converter.

Inductor components are passive electrical devices that generally include a coil of wire with opposed terminals that is wrapped about a core. The core is generally formed of a ferromagnetic material, which causes energy from current flowing through the coil to be stored temporarily in a magnetic field generated by the current flow through the coil and oppose change in current flow through the inductor. The external inductor components generally add size and weight to electronic assemblies and systems.

Such conventional methods and systems have generally been considered satisfactory for their intended purpose. However, there is still a need in the art for improved transformer-inductor assemblies. The present disclosure provides a solution for this need.

SUMMARY OF THE INVENTION

A transformer-inductor assembly includes a core, a primary winding, and a secondary winding. The primary winding is wrapped about the core. The secondary winding is wrapped about the primary winding. Two or more ferromagnetic bars are arranged between the secondary and primary windings to generate series inductance in the secondary winding.

In certain embodiments, the ferromagnetic bars can be electrically isolated from the primary and the secondary windings. The primary winding can be arranged between the ferromagnetic bars and the core. Two or more of the ferromagnetic bars can be separated from one another by the core. Two or more of the ferromagnetic bars on opposite sides of the core can be separated from one another by the primary winding. A non-ferromagnetic filler can be between the ferromagnetic bars. The core can have an A-phase limb, a B-phase limb, and a C-phase limb. Ferromagnetic bars can be arranged between the A-phase limb and the B-phase limb. Ferromagnetic bars can be arranged between the B-phase limb and the C-phase limb.

In accordance with certain embodiments, one or more of the ferromagnetic bars can define a longitudinal axis. The ferromagnetic bar can have a primary winding surface arranged between the longitudinal axis and the primary winding. The ferromagnetic bar can have a secondary winding surface arranged between the longitudinal axis and the secondary winding. The width of the ferromagnetic bar can separate the secondary winding from the primary winding. It is contemplated that the ferromagnetic bars can be formed from magnetic sheet members laminated together, a magnetic composite material, or a sintered ferromagnetic powder.

It is also contemplated that, in accordance with certain embodiments, the primary winding can abut the primary winding surface. The primary winding can be orthogonal relative to the longitudinal axis. The secondary winding can abut the secondary winding surface. The secondary winding can be orthogonal relative to the longitudinal axis. An inductor component can be connected in series with the secondary winding. A power converter can be connected directly to the secondary winding without an intervening inductor component.

An electrical system includes a power source and a transformer-inductor assembly as described above. The primary winding of the transformer-inductor assembly is connected to the power source. The core of the transformer-inductor assembly extends axially beyond ends of one or more one of the ferromagnetic bars. In certain embodiments, a power converter can be connected to the transformer-inductor assembly. The power converter can be a force commutated power converter. The transformer-inductor assembly can have a delta-wye or a wye-wye arrangement. An inductor can be connected to the transformer-inductor assembly. The inductor can electrically connect the transformer-inductor assembly to the power converter. The transformer-inductor assembly can connected directly to the power converter and without an intervening inductor.

A method of transforming voltage of AC power includes receiving an AC flow with a first voltage at a primary winding wrapped about a core. Magnetic flux is generated with the AC flow. The magnetic flux is communicated to a secondary winding wrapped about the core through ferromagnetic bars arranged between the secondary and primary windings, and an AC flow is induced in the secondary with a second voltage using the magnetic flux communicated with the ferromagnetic bars.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
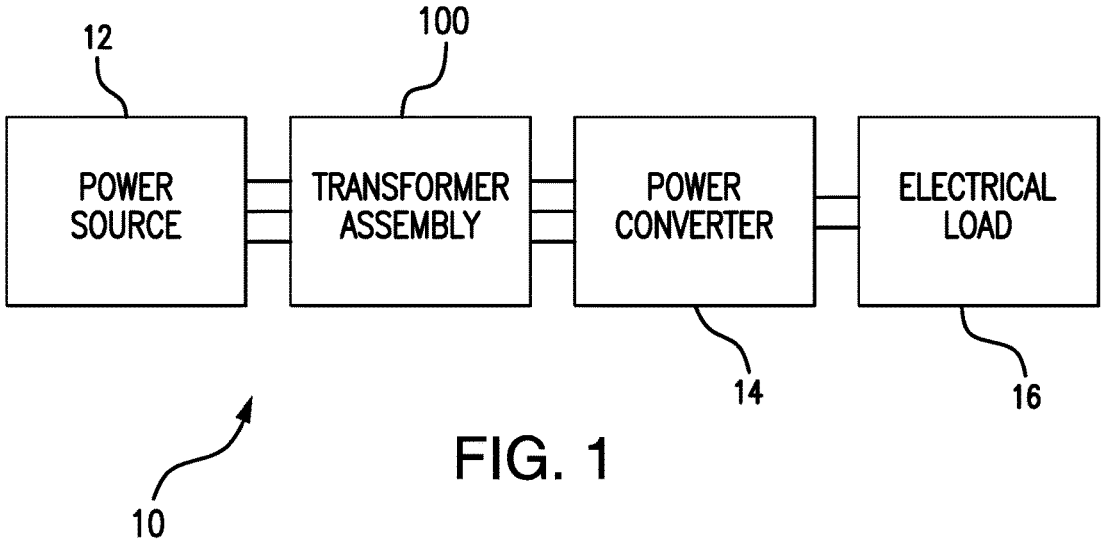
FIG. 1 is a functional diagram of an electrical system constructed in accordance with the present disclosure, showing an integrated transformer-inductor assembly connecting a power source with an electrical load through a power converter.

Reference will now be made to the drawings wherein like reference numerals identify similar structural features or aspects of the subject disclosure. For purposes of explanation and illustration, and not limitation, a partial view of an exemplary embodiment of a transformer-inductor assembly in accordance with the disclosure is shown in FIG. 1 and is designated generally by reference character 100. Other embodiments of transformer-inductor assemblies, electrical systems, and methods of transforming electrical power in accordance with the disclosure, or aspects thereof, are provided in FIGS. 2-6, as will be described. The systems and methods described herein can be used to transform alternating current (AC) power with a first voltage to a second voltage, such as in direct current (DC) power supplies such as in aircraft, though the present disclosure is not limited to DC power supplies or to aircraft electrical systems in general.

Referring to FIG. 1, an electrical system 10 is shown. Electrical system 10 includes a power source 12, transformer-inductor assembly 100, a power converter 14, and an electrical load 16. Power source 12 is an AC power source, such as an electrical grid or generator source, and is connected to transformer-inductor assembly 100. Transformer-inductor assembly 100 is configured for transforming voltage of AC power received from power source 12 into voltage suitable for electrical load 16, and is connected to power converter 14. Power converter 14 connects transformer-inductor assembly 100 to electrical load 16 and is arranged to convert AC power received from transformer-inductor assembly 100 into power suitable for electrical load 16. Transformer-inductor assembly 100 includes an integrated inductor 108 (shown in FIG. 2) comprising a plurality of ferromagnetic bars 116 (shown in FIG. 2), as will be described.

Figure 2:
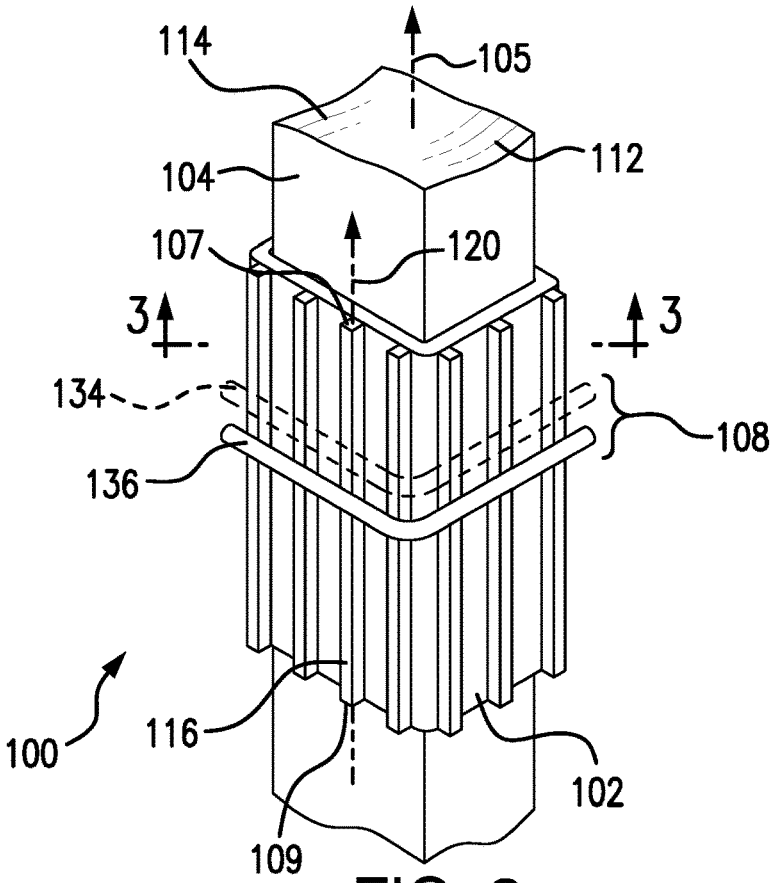
FIG. 2 is a perspective view of a portion of the transformer-inductor assembly of FIG. 1, showing an integrated inductor comprising ferromagnetic bars arranged between primary and secondary windings of the transformer-inductor assembly.

With reference to FIG. 2, transformer-inductor assembly 100 is shown. Transformer-inductor assembly 100 includes a core 104, a primary winding 102, a secondary winding 106 (shown in FIG. 3), and ferromagnetic bars 116. Core 104 is arranged along a core axis 105, is formed from a ferromagnetic material, and is configured for communicating magnetic flux between primary winding 102 and secondary winding 106. In certain embodiments the ferromagnetic material forming core 104 can be incorporated in a plurality of sheet members 112 formed from a magnetic steel material and laminated together. Use of sheet members in core 104 can provide relatively low eddy current losses and therefore can provide relatively good efficiency. It is also contemplated that the ferromagnetic material forming core 104 can be incorporated in a soft magnetic composite material or sintered ferromagnetic powder 114, allowing additional control of the reluctance of core 104.

Primary winding 102 includes a plurality of primary coils, e.g., primary coils 134, and is electrically connected to power source 12 (shown in FIG. 1). Primary winding 102 is wrapped about core 104 such that AC flowing therethrough generates a magnetic field and induces an AC current flow in secondary winding 106. In the illustrated exemplary embodiment primary coil 134 are substantially orthogonal relative to core axis 105.

Secondary winding 106 (shown in FIG. 1) includes a plurality of secondary coils, e.g., secondary coil 136, and is electrically connected to electrical load 16 (shown in FIG. 1). Secondary winding 106 is wrapped about primary winding 102 and core 104 such that current flowing through primary winding 102 creates a varying magnetic flux that induces AC voltage in secondary winding 106. In the illustrated exemplary embodiment secondary coils 136 (shown in FIG. 2) are substantially orthogonal relative to core axis 105.

Ferromagnetic bars 116 extend axially along respective longitudinal axes 120 overlapping primary winding 102. Core 104 extends axially along core axis 105 beyond longitudinally opposite ends 107 and 109 of at least one of the ferromagnetic bars 116. It is contemplated that the respective longitudinal axes 120 of ferromagnetic bars 116 be substantially parallel to core axis 105.

Figure 3:
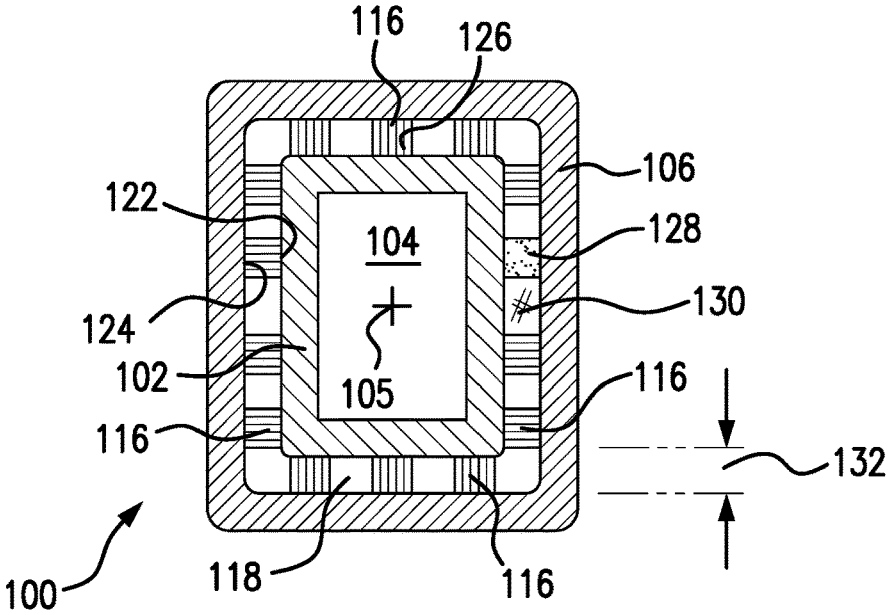
FIG. 3 is a plan view of the transformer assembly of FIG. 1, showing the ferromagnetic bars separating the primary and secondary windings of the transformer-inductor assembly.

With reference to FIG. 3, transformer-inductor assembly 100 is shown in a longitudinal cross-sectional view. Core 104 has a cross-sectional profile that extends radially about core axis 105. Primary winding 102 is wrapped about core 104 and is in an inner position. Ferromagnetic bars 116 are distributed radially outward of primary winding 102 and are arranged on a side primary winding 102 opposite core 104. Secondary winding 106 is wrapped about ferromagnetic bars 116, is arranged on a side of ferromagnetic bars 116 opposite primary winding 102, and is in an outer position. In certain embodiments transformer-inductor assembly 100 configured as a step-up transformer, secondary winding 106 having more turns (coils) than primary winding 102. In accordance with certain embodiments transformer-inductor assembly 100 can be a step-down transformer, secondary winding 106 having fewer turns (coils) than primary winding 102. It is contemplated that ferromagnetic bars 116 be electrically isolated from both primary winding 102 and secondary winding 106.

Each ferromagnetic bar 116 has a primary winding surface 122 and an opposed secondary winding surface 124. Primary winding surface 122 faces core 104 and overlaps primary winding surface 122. Secondary winding surface 124 faces secondary winding 106 and is overlapped by secondary winding 106. The ferromagnetic bars 116 are arranged between secondary winding surface 124 and primary winding surface 122. In certain embodiments the ferromagnetic material is incorporated in a plurality of sheet members 126 formed from a magnetic steel material and laminated together, providing a relatively inexpensive construction and/or relatively large integrated transformer-inductor assemblies. In accordance with certain embodiments, ferromagnetic bars 116 can be a formed from a soft magnetic composite material or sintered ferromagnetic powder 128, such compositions allowing for tuning the inductance of the integrated inductor of transformer-inductor assembly 100 by composition adjustment during manufacture as well as by dimension selection of ferromagnetic bars 116.

A non-ferromagnetic gap 118 is defined between circumferentially adjacent ferromagnetic bars 116. Non-ferromagnetic gap 118 extends radially between primary winding surface 122 and secondary winding surface 124 and radially spans each of the circumferentially adjacent ferromagnetic bars 116. In certain embodiments non-ferromagnetic gap 118 is an air gap. In accordance with certain embodiments non-ferromagnetic gap 118 can be occupied by a non-ferromagnetic filler 130. Non-magnetic filler 130 can include a material with greater magnetic reluctance than the ferromagnetic material forming ferromagnetic bars 116.

During operation power source 12 (shown in FIG. 1) provides primary winding 102 an AC flow to primary winding 102. The primary winding AC flow generates a magnetic field in core 104 and communicates magnetic flux through ferromagnetic bars 116 to secondary winding 106. The magnetic flux induces a secondary winding AC voltage in secondary winding 106, which secondary winding 106 supplies to electrical load 16 through power converter 14 as electrical power suitable for electrical load 16. Ferromagnetic bars 116 provide a change in the inductance of secondary winding 106 without altering the number of turns (coils) of secondary winding 106. The controlled inductance reduces requirements to the size of an inductor 24 (shown in FIG. 6) connected between secondary winding 106 and power converter 14 (shown in FIG. 1). It is contemplated that the controlled inductance can eliminate the need for an inductor component connected in series between transformer-inductor assembly 100 and electrical load 16.

Figure 4:
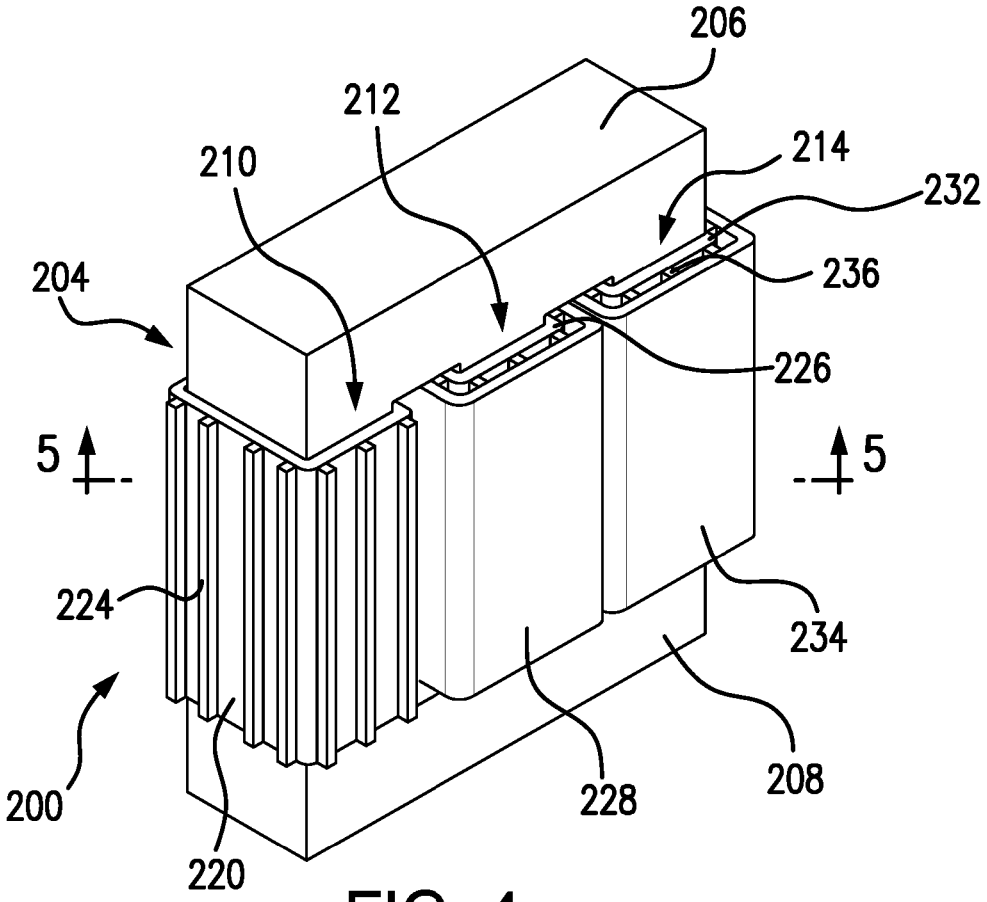
FIG. 4 is a perspective view of a 3-phase transformer-inductor assembly, showing the arrangement of the ferromagnetic bars between primary and secondary windings of the 3-phase transformer-inductor assembly.
Figure 5:
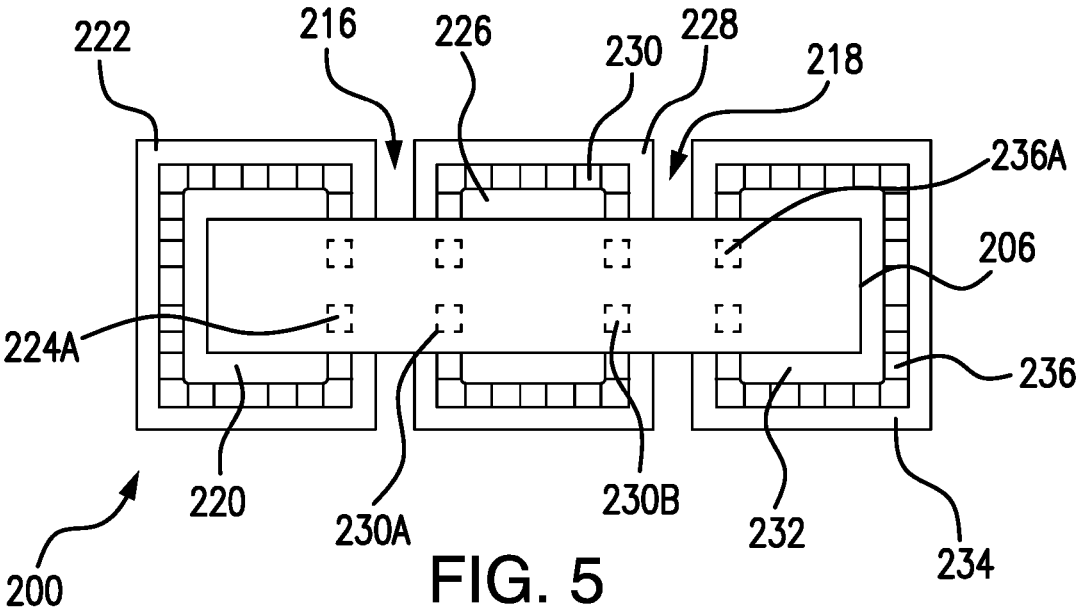
FIG. 5 is a plan view of the transformer of FIG. 4, showing the arrangement of the ferromagnetic bars in relation to the yoke in the transformer-inductor assembly.

With reference to FIGS. 4 and 5, a transformer-inductor assembly 200 is shown. Transformer-inductor assembly 200 is similar to transformer-inductor assembly 100 (shown in FIG. 1) and is configured for transforming 3-phase power from a first voltage to a second voltage. In this respect transformer-inductor assembly 200 includes a core 204 with a first yoke 206, a second yoke 208, an A-phase limb 210, a B-phase limb 212, and a C-phase limb 214. A-phase limb 210 extends between first yoke 206 and second yoke 208. B-phase limb 212 extends between first yoke 206 and second yoke 208 and is spaced apart from A-phase limb 210 by a gap 216. C-phase limb 214 extends between first yoke 206 and second yoke 208, is spaced apart from B-phase limb 212 by a gap 218.

An A-phase primary winding 220 and an A-phase secondary winding 222 are wrapped about A-phase limb 210. A-phase ferromagnetic bars 224 (shown in FIG. 4) are distributed about A-phase limb 210 and are arranged between A-phase primary winding 220 and A-phase secondary winding 222. Core 204 (shown in FIG. 4) can extend axially beyond longitudinally opposite ends of at least one of the ferromagnetic bars 224. At least one A-phase ferromagnetic bar 224A (shown in FIG. 5) is axially overlapped by first yoke 206 and second yoke 208.

A B-phase primary winding 226 and a B-phase secondary winding 228 are wrapped about B-phase limb 212. B-phase ferromagnetic bars 230 are distributed about B-phase limb 212. The B-phase ferromagnetic bars 230 are arranged between B-phase primary winding 226 and B-phase secondary winding 228. At least one B-phase ferromagnetic bar 230A is disposed within gap 216 and axially overlapped by first yoke 206 and second yoke 208. At least one B-phase ferromagnetic bar 230B is disposed within gap 218 and axially overlapped by first yoke 206 and second yoke 208.

A C-phase primary winding 232 and a C-phase secondary winding 234 are wrapped about C-phase limb 214. C-phase ferromagnetic bars 236 are distributed about C-phase limb 214 and are arranged between C-phase primary winding 232 and C-phase secondary winding 234. At least one C-phase ferromagnetic bar 236A is disposed within gap 218 and is axially overlapped by first yoke 206 and second yoke 208.

Figure 6:
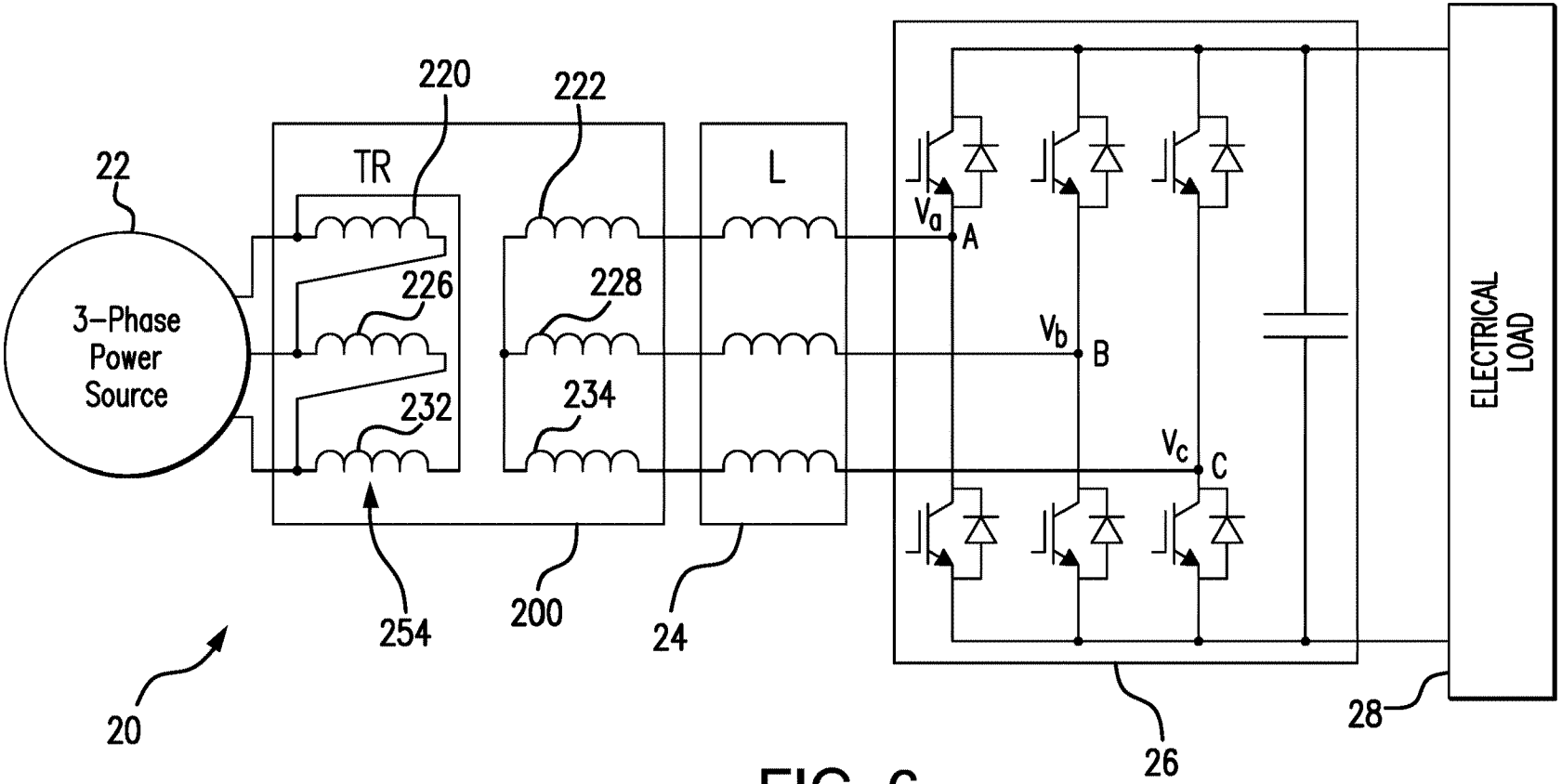
FIG. 6 is a circuit diagram of an electrical system including the transformer-inductor assembly of FIG. 4, showing a power converter and optional inductor connecting the transformer-inductor assembly to a power converter.

Referring now to FIG. 6, an exemplary 3-phase electrical system 20, e.g., an DC power supply, is shown. Electrical system 20 includes a 3-phase power source 22, transformer-inductor assembly 200, a 3-phase inductor 24, a power converter 26, and an electrical load 28. The 3-phase power source 22 is connected to primary windings, i.e., A-phase primary winding 220, B-phase primary winding 226, and C-phase primary winding 232, by three phase leads. The 3-phase power source 22 can be a grid or a generator.

Secondary windings, i.e., A-phase secondary winding 222, B-phase secondary winding 228, and C-phase secondary winding 234, are connected to power converter 26 through inductor 24. Electrical load 28, which in the illustrated exemplary embodiment is a DC power load, is connected to power converter 26 through a DC source lead and a DC return lead. It is contemplated that inductor 24 include a discrete inductor component, such as coil wound about a toroid core inductor component, and is optional.

Windings of transformer-inductor assembly 200 can be arranged with a delta-wye arrangement, thereby limiting third-harmonic current flowing in the power lines connecting transformer assembly 200 with 3-phase power source 22 when converting power received from power source 208 to power suitable for electrical load 28. In certain embodiments transformer assembly 200 can have a wye-wye arrangement. Although illustrated with inductor 24 interconnecting transformer-inductor assembly 200 with power converter 26, it is to be understood and appreciated that inductor 24 is optional. In this respect the ferromagnetic bars of transformer-inductor assembly 200 can be configured with suitable cross-sectional area, number, and composition to adjust inductance of the secondary windings of transformer-inductor assembly 200 to a desired inductance value such that no inductor L is required between transformer-inductor assembly 200 and power converter 26, e.g., electrical system 20 has no inductor component external to integrated transformer-inductor assembly 200 and power converter 26.

Electromagnetic components like transformers, reactors, inductors, chokes, solenoids, etc. can occupy significant amounts of space in electronic assemblies, such as in power electronics circuits or systems. Normally, the secondary winding of a transformer cannot serve as an inductor because there are competing design requirements between transformer secondary windings and inductor windings. Specifically, the number of secondary winding turns is typically restricted by the transformer voltage rating, so the number of secondary winding turns cannot be adjusted to control the inductance by increasing or decreasing the number of secondary winding turns.

In embodiments described herein, integrated transformer-inductor assemblies are described having ferromagnetic bars arranged between the primary windings and the secondary windings of the transformer-inductor assembly. By selecting one or more of the number, composition, and dimensioning (e.g., cross-sectional area) of the ferromagnetic bars it is possible to control the inductance of the transformer secondary winding independent of the number secondary winding turns. Such transformers-inductor assemblies can reduce the size or eliminate entirely the inductor component that otherwise would need to be connected to the transformer secondary windings. It is contemplated that any associated increase in the mass or size of the transformer-inductor assembly relative to a conventional transformer be offset by the associated reduction in mass or size of the electrical system by less massive or smaller (or omitted entirely) serially-connected discrete inductor component.

In accordance with certain embodiments, the ferromagnetic bars can be made from a soft magnetic composite material or a sintered ferromagnetic powder material. It is also contemplated that the ferromagnetic bars can also be made from sheet members formed from a magnetic steel material, facilitating construction of relative large transformers. Further, the secondary winding inductance can be adjusted independent of the number of transformer secondary winding turns, independent of transformer output voltage, by selection of one or more of the number of ferromagnetic bars, cross-sectional area of the ferromagnetic bars, and material forming the ferromagnetic bars due to the a controlled amount of 'leakage' (series) inductance provided by the ferromagnetic bars. In contemplated embodiments magnetic coupling between transformer-inductor assembly influence the primary winding inductance.

It is contemplated that embodiments of the transformer-inductor assemblies described herein be employed in electrical systems with DC power supplies. It is also contemplated that transformer-inductor assemblies have a delta-wye arrangement, an inductor formed from the ferromagnetic bars, and a force commutated converter. As will be appreciated by those of skill in the art in view of the present disclosure, the delta-wye arrangement of such transformer-inductor assemblies can prevent third-harmonic currents in the generator power lines. As will also be appreciated by those of skill in the art in view of the present disclosure, certain embodiments of transformer-inductor assemblies described herein can be boost inductors in operation of force-commutated converters, the integrated arrangement of the ferromagnetic bars reducing the space and weight of DC power supplies by reducing the size (or eliminating entirely) of the discrete inductor component that generally must be connected in series with the transformer secondary windings.

The methods and systems of the present disclosure, as described above and shown in the drawings, provide for transformer-inductor assemblies, electrical systems, and methods transforming AC power voltage with superior properties including one or more of simplified electrical architecture, weight reduction, size reduction, and/or cost reduction by decreasing the amount of copper magnetic wire necessary in construction of the transformer-inductor assembly or electrical system. While the apparatus and methods of the subject disclosure have been shown and described with reference to preferred embodiments, those skilled in the art will readily appreciate that change and/or modifications may be made thereto without departing from the scope of the subject disclosure.

What is claimed is:

1. A transformer-inductor assembly, comprising:

a core;

a primary winding wrapped about the core;

a secondary winding wrapped about the primary winding; and a plurality of ferromagnetic bars arranged between the secondary winding and the primary winding to add leakage inductance to the transformer, wherein the ferromagnetic bars have primary and secondary winding surfaces arranged on opposite sides of a longitudinal axis, wherein the primary winding surface overlaps the primary winding, wherein the secondary winding overlaps the secondary winding surface.

2. The transformer-inductor assembly as recited in claim 1, wherein the ferromagnetic bars are electrically isolated from the primary winding and the secondary winding.

3. The transformer-inductor assembly as recited in claim 1, wherein the primary winding is arranged between the ferromagnetic bars and the core.

4. The transformer-inductor assembly as recited in claim 1, further comprising a non-ferromagnetic filler disposed between at least two of the ferromagnetic bars.

5. The transformer-inductor assembly as recited in claim 1, wherein the ferromagnetic bars comprise a plurality of sheet members laminated to one another.

6. The transformer-inductor assembly as recited in claim 1, wherein the ferromagnetic bars comprise a magnetic composite material or a sintered ferromagnetic powder.

7. The transformer-inductor assembly as recited in claim 1, wherein widths defined between the primary winding surfaces and the secondary winding surfaces of the ferromagnetic bars separate the secondary winding from the primary winding.

8. The transformer-inductor assembly as recited in claim 1, wherein the primary winding abuts the primary winding surfaces and is orthogonal relative to the longitudinal axes of ferromagnetic bars.

9. The transformer-inductor assembly as recited in claim 1, wherein the secondary winding abuts the secondary winding surfaces and is orthogonal relative to the longitudinal axes of the ferromagnetic bars.

10. The transformer-inductor assembly as recited in claim 1, further comprising a power converter connected in series with the secondary winding.

11. The transformer-inductor assembly as recited in claim 1, wherein the core includes a plurality of sheet members laminated to one another or a ferrite material.

12. An electrical system, comprising:

a power source; and a transformer-inductor assembly, including:

a core;

a primary winding wrapped about the core;

a secondary winding wrapped about the primary winding; and a plurality of ferromagnetic bars arranged between the secondary winding and the primary winding to add leakage inductance to the transformer, wherein the transformer-inductor assembly primary winding is connected to the power source, wherein transformer-inductor assembly core extends axially beyond ends of at least one of the ferromagnetic bars.

13. The electrical system as recited in claim 12, further comprising a power converter connected to the transformer-inductor assembly.

14. A method of transforming voltage of alternating current (AC) power, comprising:

receiving alternating current with a first voltage at a primary winding wrapped about a core;

generating a varying magnetic flux in the transformer core;

communicating the magnetic flux to a secondary winding wrapped about the core through a plurality of ferromagnetic bars arranged between the secondary winding and the primary winding; and inducing an AC voltage in the secondary winding.

* * * * *